US011839588B2

(12) United States Patent
Arkans et al.

(10) Patent No.: US 11,839,588 B2
(45) Date of Patent: Dec. 12, 2023

(54) SYSTEMS AND METHODS FOR MULTIPLE PULSES FOR TREATMENT OF VASCULAR CONDITIONS

(71) Applicant: GNOTRIX, LLC, San Marcos, CA (US)

(72) Inventors: Edward Arkans, Carlsbad, CA (US); Brian Lakin, Escondido, CA (US)

(73) Assignee: GNOTRIX, LLC, San Marcos, CA (US)

( * ) Notice: Subject to any disclaimer, the term of this patent is extended or adjusted under 35 U.S.C. 154(b) by 728 days.

(21) Appl. No.: 14/803,012

(22) Filed: Jul. 17, 2015

(65) Prior Publication Data

US 2016/0175184 A1 Jun. 23, 2016

Related U.S. Application Data

(60) Provisional application No. 62/026,026, filed on Jul. 17, 2014.

(51) Int. Cl.
*A61H 9/00* (2006.01)
*A61H 23/02* (2006.01)

(52) U.S. Cl.
CPC ..... *A61H 9/0092* (2013.01); *A61H 23/0263* (2013.01); *A61H 2201/5002* (2013.01); *A61H 2201/5071* (2013.01); *A61H 2205/106* (2013.01); *A61H 2205/12* (2013.01); *A61H 2209/00* (2013.01)

(58) Field of Classification Search
CPC ..... A61H 9/0092; A61H 23/0263; A61H 2201/5002; A61H 2201/5071; A61H 2205/12; A61H 2205/106; A61H 2209/00; A61H 9/005; A61H 9/0071; A61H 9/0078; A61H 2201/5005; A61H 2201/5056; A61H 2021/5074; A61H 2201/5076; A61B 5/02141; A61B 5/02133; A61B 5/02233; A61B 5/0235; A61B 17/132; A61B 8/4227; A61B 17/1322; A61B 17/1325; A61B 17/135; A61B 17/1355; A61B 5/0053; A61B 5/0051; A61B 2017/00535; A61B 2017/00544; A61B 2017/00557; A61B 2017/22051; A61B 2018/1876
USPC ..... 601/88, 96, 148–152
See application file for complete search history.

(56) References Cited

U.S. PATENT DOCUMENTS 4,186,732 A * 2/1980 Christoffel ..... A61H 9/0078 601/150
4,481,937 A 11/1984 Arkans
4,928,674 A * 5/1990 Halperin ..... A61H 31/006 601/44

(Continued)

OTHER PUBLICATIONS

Weinheimer-Haus, Judex, Ennis & Koh, Low-Intensity Vibration Improves Angiogenesis and Wound Healing in Diabetic Mice, PLoS One, Mar. 2014, vol. 9, Issue 3.

*Primary Examiner* — Shila Jalalzadeh Abyaneh
(74) *Attorney, Agent, or Firm* — Henricks Slavin LLP

(57) ABSTRACT

Arterial compression methods and apparatus may include high-frequency pulse waveforms applied to one or more cuffs on a limb. Additionally or alternatively, they may include high inflation rate configurations, such as may be used to more quickly inflate a cuff on a limb. They may also include inflating a cuff on a limb using a plurality of inflation pulses.

40 Claims, 5 Drawing Sheets

(56) References Cited

U.S. PATENT DOCUMENTS 5,029,589 A * 7/1991 Kato ..... A61B 5/02225 600/495
5,089,961 A 2/1992 Coble et al.
5,353,525 A * 10/1994 Grim ..... A43B 7/081 36/114
5,496,262 A * 3/1996 Johnson, Jr. ..... A61H 9/0078 601/152
5,518,000 A * 5/1996 Booth ..... A61B 5/02225 600/493
5,584,798 A * 12/1996 Fox ..... A61H 9/0078 601/150
5,681,339 A * 10/1997 McEwen ..... A61H 9/0078 606/202
5,968,073 A * 10/1999 Jacobs ..... A61B 34/74 601/152
6,007,559 A 12/1999 Arkans
6,129,688 A 10/2000 Arkans
6,736,787 B1 * 5/2004 McEwen ..... A61H 9/0078 601/152
6,905,456 B1 * 6/2005 Brunner ..... A61H 9/0078 600/16
7,485,131 B2 * 2/2009 Hovanes ..... A61B 5/02208 606/202
9,872,812 B2 * 1/2018 Malhi ..... A61H 9/00
2002/0151929 A1 * 10/2002 Goto ..... A61H 9/0078 606/202
2003/0139255 A1 * 7/2003 Lina ..... A61H 9/0078 482/24
2009/0062703 A1 * 3/2009 Meyer ..... A61H 9/0078 602/13
2009/0143720 A1 * 6/2009 Hovorka ..... A61H 9/0078 604/23
2012/0220905 A1 * 8/2012 Avni ..... A61H 9/0078 601/2
2014/0094726 A1 * 4/2014 Malhi ..... A61F 13/08 601/152
2014/0163402 A1 * 6/2014 Lamego ..... A61B 5/0235 600/493
2016/0262971 A1 * 9/2016 Doron ..... A61H 9/0092

* cited by examiner

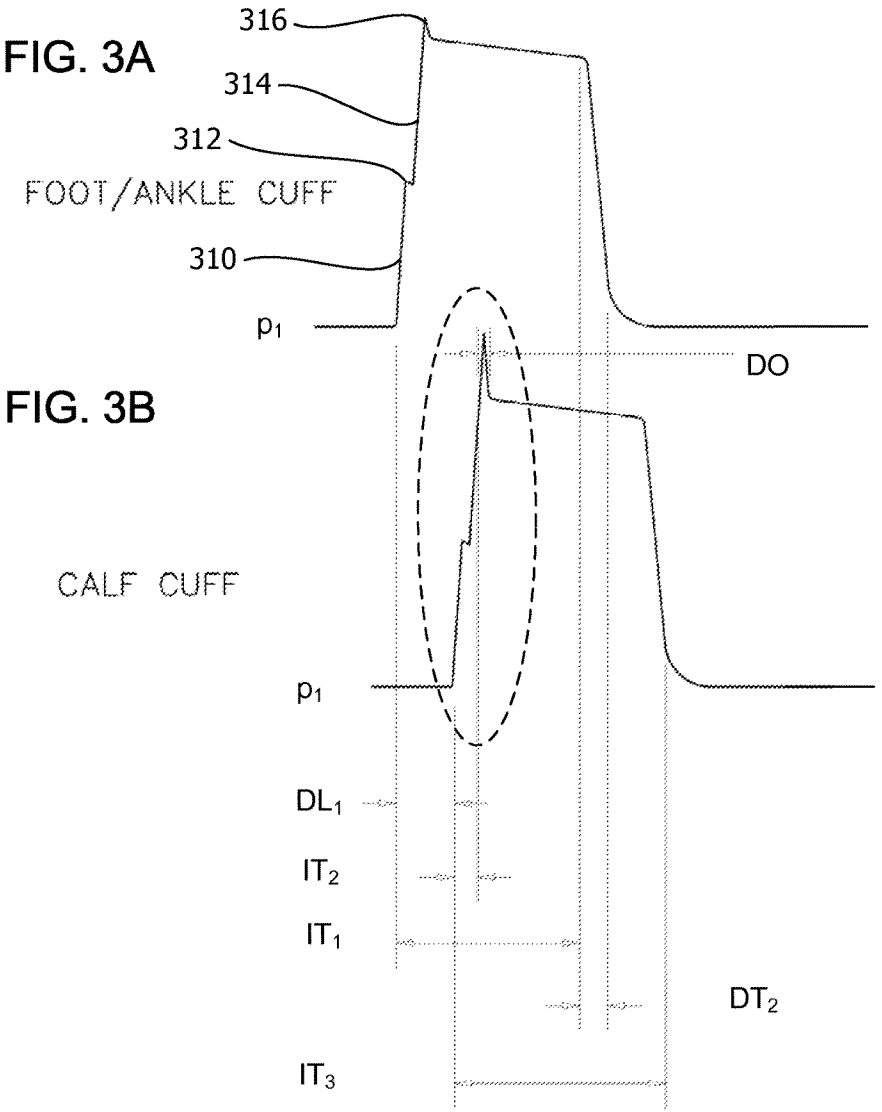
FIG. 3A
FIG. 3B
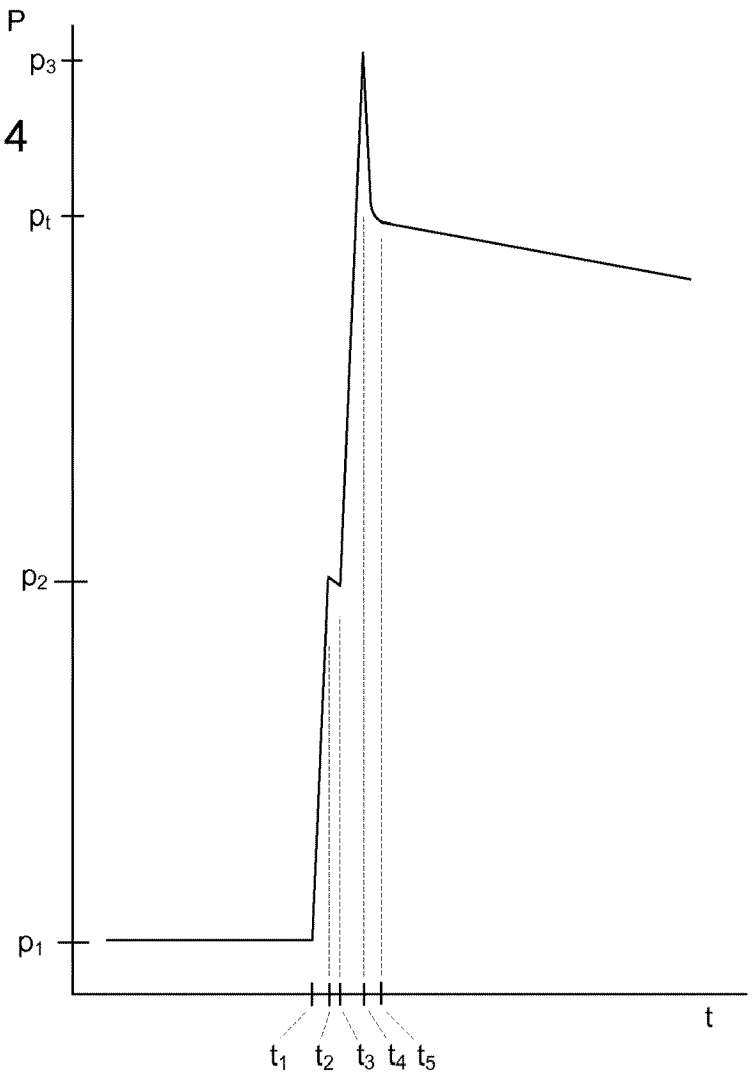
FIG. 4

SYSTEMS AND METHODS FOR MULTIPLE PULSES FOR TREATMENT OF VASCULAR CONDITIONS

RELATED APPLICATION

The present application is a Non-Provisional application claiming priority to U.S. Provision Application Ser. No. 62/026,026, filed Jul. 17, 2014, the disclosure of which is herein incorporated by reference.

BACKGROUND

1. Field

This relates to methods and apparatus for improving vascular blood flow, for example for improving arterial blood flow in the lower extremities, and/or enhancing functionality of vessels such as with high shear rates, for example which may be accomplished through the use of conventional or modified vascular assist pneumatic compression pumps, commonly known as peripheral arterial disease pumps.

2. Related Art

Peripheral arterial disease (PAD) pumps are common for improving arterial blood flow in the lower extremities. The characteristics of and some of the methods of using such pumps are described in one or more of U.S. Pat. Nos. 6,129,688, 6,007,559, 5,089,961 and 4,481,937, the disclosures of which are incorporated herein by reference in their entirety. Conventional pumps often use a tank and compressor for producing pressurized air or other fluid to a manifold, valves for controlling the application of air for inflating one or more fluid bladders that are within cuffs (foot and calf cuffs for left and right legs), and controlling the removal of air for deflating the cuffs through appropriate tubing. The tank is generally pressurized and maintained at 20 PSI nominal. The pumps also include an adjustable, mechanical air pressure regulator set to an output pressure of 120 mm Mercury between the tank and the manifold. The cuff bladders for the left and right legs are inflated and deflated through actuation of two 2-position solenoid valves according to the desired sequence and pressures, determined by an electronic controller.

In a conventional assembly, including pump, tubing and cuffs, one valve per cuff bladder type provides 2-position control, namely, one position for filling and one position for exhaust or deflating, the timing and sequence for which is controlled by the electronic controller. The fill position of the valve releases the pressure-regulated air into each limb cuff bladder, the valve remaining open until such time as the cuff bladder is to be deflated by the exhaust position of the valve. About 6-10 mm Hg of air pressure is held in the cuff bladders by a mechanical check valve, as a baseline inflation so that subsequent cuff bladder inflation can be more rapid than otherwise. Typically, a foot/ankle cuff bladder is inflated first, followed by installation of a calf cuff bladder. Each is held for 3 seconds before deflation, the foot cuff bladder being deflated first, followed by the calf cuff bladder. The cycle repeats each 20 seconds for a therapy time of 60 minutes. After the 60 minute period, an alarm sounds and/or visual indicator shows that therapy is terminated.

In another conventional assembly, pressures may be applied to the limbs using mechanical devices such as belts that are tightened and loosened using motors or other mechanical actuators. The following improvements may be applied also to such compression techniques in place of the fluid-inflated cuff bladders described, in other words with any limb compression control device. Therefore, the description with respect to application to cuff bladders or other inflatable devices also applies to other limb compression devices, with a suitable modifications.

SUMMARY

Methods and apparatus may be used to improve vascular blood flow, for example using conventional peripheral arterial disease pumps or using modified pumps. In one example, a conventional pump can be used with conventional tubing and cuff bladders and an external device for applying high-frequency pulses to one or more of the cuff bladders. High-frequency in the present context may be a frequency greater than the conventional compression cycles, for example greater than one in every 20 seconds or greater than one every minute, and may be as high as 30, 45, or even 100 Hz. The high-frequency generator may be an external or accessory device applied to or in line with the inflation tubing between the conventional pump and a cuff bladder, or the high-frequency generator may be implemented in software or firmware as part of a modified pump. For example, pulses can be applied cyclically to tubing for a cuff bladder, for example by cyclically constricting tubing using an external force on the tubing. Alternatively, pulses can be applied pneumatically with a pneumatic pulse generator in line with the tubing to the cuff bladder. An example of a pneumatic pulse generator is the use of a diaphragm in fluid communication with the cuff bladders that is moved in an oscillatory fashion by an electromagnetic device such as a solenoid or motor and cam assembly. Pulses may be low intensity pulses, or they may be of a magnitude similar to a baseline pressure for a cuff bladder.

In a further example of methods and apparatus for improving vascular blood flow, a conventional peripheral arterial disease pump can be modified to produce high-frequency pneumatic pulses, for example by repeatedly actuating the fill/exhaust valves, incorporating an additional valve for supplying the high-frequency pneumatic pulses into the cuff bladder tubing, or by other configurations. Pulses can be a combination of inflation followed by deflation, a combination of inflation followed by inflation, a combination of deflation followed by deflation, or a combination of deflation followed by inflation.

In any of the examples for applying high-frequency pulses to a cuff bladder, the high-frequency pulses can be applied continuously, during cuff pressurization or cuff bladder inflation, during cuff depressurization or cuff bladder deflation, during the period when the cuff is static or the cuff bladder is maintained inflated or deflated, or any combination thereof. The high-frequency pulses can be applied to a single pressure device or cuff bladder, fewer than all pressure devices or cuff bladders or to all pressure devices or cuff bladders. High-frequency pulses can be applied throughout an entire treatment duration such as for a 60 minute, 90 minute or longer treatment regimens, for example a 120 minute treatment regimen, or at different stages of the treatment.

In another example of methods and apparatus for improving vascular blood flow, a peripheral arterial disease pump can be configured to provide a plurality of inflation pulses to reach a target cuff bladder pressure, for example where any given pulse is insufficient alone to inflate the cuff bladder to the desired pressure. The plurality of inflation pulses can be applied sequentially at or over approximately equal intervals, or with different intervals, for example a first inflation pulse over a long interval followed by a second or further inflation pulses over shorter intervals until the desired cuff bladder pressure is reached. The plurality of inflation pulses can be applied according to one or more of pressures, intervals and timing set by a controller alone, or in combination with sensing the cuff bladder pressure during or at various stages of the inflation. In one example, a cuff bladder can be inflated and the pressure at or to the cuff bladder sensed and fed back to a controller. The controller can then actuate further inflation according to a set interval one or more times until a target pressure is reached or exceeded, or the controller can calculate an estimated interval of a further inflation to reach the target pressure. Further pressure sensing can also determine possible pressure overshoot in the cuff bladder and the cuff bladder is deflated to the target pressure, or one or more valves actuated to iteratively and adaptively approach the target pressure until the target pressure is reached. The adaptive aspect of this example allows for accurate pressures to be reached whether one or two or more limb cuffs are used or if the limb cuffs are applied to the limb snuggly or loosely or to account for temperature variations of the fluid and operating components including solenoid valves. Other methods and apparatus may also be used to inflate a cuff bladder in a peripheral arterial disease pump assembly using a plurality of inflation pulses to reach a target cuff bladder pressure.

In a further example of methods and apparatus for improving vascular blood flow, a peripheral arterial disease pump can be configured to provide a plurality of inflation pulses to reach a target cuff bladder pressure where the plurality of inflation pulses are separated by a period of static pressure condition, and the duration of an inflation pulse may be significantly different than the duration of a pause or static pressure condition. In one example, the period of duration of an inflation pulse may be several hundred milliseconds, and in some examples even less than 100 milliseconds. In one example of inflation pulse duration, the duration is approximately 30 milliseconds and the duration is variable when adaptive techniques are used, while the duration of a static pressure period may be on the order of approximately 40 milliseconds or longer. In one configuration, there are plural inflation pulses and a single static pressure period, or there may be multiple static pressure periods.

In another example of methods and apparatus for improving vascular blood flow, a peripheral arterial disease pump can be configured to more quickly inflate a cuff bladder to be connected to the pump, for example by providing a higher pressure at an outlet of the pump to which tubing for the cuff bladder is to be connected. For a given cuff bladder tubing size, a higher fluid pressure may be used to more quickly inflate the cuff bladder. In another configuration, an inflation valve can be placed in-line with a higher pressure source so that when the inflation valve is fully open, a higher pressure can be applied to any cuff bladder tubing connected to that portion of the pump. In one configuration, the inflation valve can be placed in-line with a 20 PSI pressure for inflating a cuff and associated bladders such as from a pressurized tank. This allows the total active inflation time to be reduced. In one example, the total cuff bladder inflation time can be less than 400 msec, and in a further example less than 250 msec. In a further example, the total inflation time can be the sum of one, two or three, 30 msec pulses. Alternatively or additionally, a larger diameter tubing can be used for inflating cuff bladders. Alternatively or additionally, a smaller diameter tubing can be used for inflating cuff bladders when the pressurized tank pressure is greater than 20 PSI.

In a further example of methods and apparatus for improving vascular blood flow, a peripheral arterial disease pump can be configured to have different valve configurations for cuff bladder inflation, and cuff bladder static pressure, and possibly also a further valve configuration for cuff bladder deflation. In one configuration, a pump can be configured with two valves for two cuff bladders (for example a single leg with a foot/ankle cuff bladder and a calf cuff bladder) or four valves for four cuff bladders (for example for two legs each with a foot/ankle cuff bladder, and a calf cuff bladder). With such a configuration, a cuff bladder can be inflated with a valve in an inflation configuration, the cuff bladder maintained pressurized with the valve in a second configuration (static pressure configuration) and the cuff bladder is deflated with a valve in a different configuration. These three valve configurations can be accomplished in a number of ways, for example with two 2-position valves for two cuff bladders, a single valve for two cuff bladders having the desired three configurations, or in other ways. In this way, a cuff bladder can be connected to a high pressure source, and inflated quickly, inflated with multiple pulses, and maintained at pressure. Also in this way, a cuff bladder can be kept inflated while having both the inflation valves and deflation valves closed. The inflation valve can be opened for increasing pressure, and closed for keeping the pressure constant, and the deflation valve can be opened for decreasing the cuff bladder pressure or deflating the cuff bladder pressure. This combination of valves can also be used in place of the mechanical check valve used in the prior art to maintain a baseline inflation or pressure in a cuff bladder, to make easier full inflation by opening the inflation valve. For example, a cuff bladder can be maintained at a baseline pressure of between 6 and 10 mm Hg. A cuff bladder can be inflated to a target pressure using one or more feedback configurations, for example using a pressure sensor for determining when the cuff bladder has reached or exceeded the target pressure, and possibly making adaptive adjustments, if any.

In another example of methods and apparatus for improving vascular blood flow, a peripheral arterial disease pump can be configured to apply a pneumatic pressure to a cuff bladder in a peripheral arterial disease therapy assembly at a pressure greater than 120 mm Hg. In one configuration, such a therapy assembly can apply a pressure to a cuff bladder at least 10% greater than 120 mm Hg, and in another configuration such an assembly can apply pressure to a cuff bladder of at least 90% of 20 PSI. For example, a peripheral arterial disease pump can have an inflation valve coupled to a manifold such as an air manifold, where the manifold is at 20 PSI, and there is no greater than a 10% pressure drop between the manifold and the inflation valve. In this configuration, fully opening the inflation valve allows the cuff bladder to see a substantially 20 PSI pressure (aside from flow losses, etc.). Such a configuration allows fast inflation of a cuff bladder. Such a configuration also allows pulsed inflation of a cuff bladder, especially with a fast-acting valve. In one configuration, a 2-way fast acting solenoid valve is used as an inflation valve, and another 2-way fast acting solenoid valve is used as a deflation valve for a cuff bladder (for example a foot/ankle cuff bladder). The same configuration of valves can be used for calf cuff bladders or other cuff bladders. A fast acting valve can be used to inflate a cuff bladder in tens of milliseconds, even with inflation occurring to a target pressure using a plurality of inflation pulses. Pulsed inflation, with or without pressure sensing feedback, can be accomplished in under 400 ms, and even under 250 ms.

In another example of methods and apparatus for improving vascular blood flow, a peripheral arterial disease pump can include a pressure tank and compressor for pressurizing the pressure tank. Air, or any other fluid in the pressure tank, is output to a manifold, to which other devices can be connected for using the pressurized fluid. An inflation valve is configured to apply pressurized fluid such as air (or any other fluid suitable for such devices) to a cuff bladder and tubing to be connected to the device. The inflation valve is connected to the manifold, and the tank, manifold and inflation valve are configured so that the fluid pressure seen by the inflation valve is the same as or not less than 90% of the fluid pressure in the tank when the tank is charged or pressurized, for example pressurized for normal operating conditions, in one example pressurized at 20 PSI. In one configuration, the manifold is in direct fluid communication with the tank, and the inflation valve is in direct fluid communication with the manifold without any significant pressure losses between the tank and the inflation valve other than conventional fluid flow losses. In a configuration where a cuff bladder and associated tubing are coupled to the pump assembly and the tank is at 20 PSI, a fully open inflation valve allows the cuff bladder to see a fluid driving pressure greater than 120 mm Hg, and even around 20 PSI, with normal fluid flow losses. In another configuration, the manifold sees approximately the same pressure as the tank, and the inflation valve sees approximately the same pressure as the manifold, and there is no pressure regulator between the tank and the inflation valve to drop the pressure below approximately 20 PSI. In this configuration, there is no device between the tank and the inflation valve which drops the pressure seen by the inflation valve more than approximately 10% of the tank pressure. Such a configuration allows the inflation valve to more closely control inflation of the cuff bladder. Such configuration also allows fast cuff bladder inflation, as well as pulsed cuff bladder inflation.

In a further example of methods and apparatus for improving vascular blood flow, a peripheral arterial disease pump includes a fluid pressurization tank, manifold and inflation valve. A fluid flow line is coupled between the inflation valve and a flow line for a cuff bladder or connector for such a flow line. A pressure sensor is included in the flow line from the inflation valve for sensing the pressure within the cuff bladder when the cuff bladder is connected to the fluid flow line. The sensed pressure is fed back to a controller. The controller can use the sensed pressure adaptively to decide whether or not further inflation is desired for the cuff bladder, for example to reach a target pressure. For example, the system can be programmed with inflation pressure intervals as a function of inflation time, and the cuff bladder inflated over several short intervals to approach or reach the target pressure. The sensed pressure can also be used to calculate a period for further inflation, for example for applying a further inflation pulse, after which the pressure sensor can sense a further pressure value for the cuff bladder, and the process repeated. Once the target pressure has been reached, the system can keep the valves closed or static to keep the cuff bladder pressure constant. If the target pressure is exceeded, the system can activate the deflation valve until the target pressure is reached, as indicated by the pressure sensor, or by closing the deflation valve after a predetermined time corresponding to a known deflation pressure/time curve or estimate.

In another example of methods and apparatus for improving vascular blood flow, a peripheral arterial disease pump assembly having one or more inflation cuff bladders can have pressure applied to the cuff bladder to pressurize the cuff bladder toward a target pressure. The application of pressure is then stopped, and then reapplied one or more times until the target pressure is reached or exceeded. In a further configuration, the cuff bladder pressure is sensed and the sensed pressure is used by a controller to determine either or both of a subsequent pulse duration and/or pulse quantity. Cuff bladder pressure can be sensed at the end of each pulse, for example after a settling time, or less often than every pulse. Cuff bladder pressure in any of the pump configurations described herein can be sensed with fast-responding pressure transducers such as semiconductor types, those using integrated circuit technologies and includes piezo-resistive and micro-mechanical technologies, for example. Additionally, flow transducers may be used in place of pressure sensors or pressure transducers, with appropriate accounting for the bladder volumes being filled.

In a further example of methods and apparatus for improving vascular blood flow, a peripheral arterial disease pump assembly having one or more inflation cuff bladders can have pressure applied to a cuff bladder at a faster rate than in previous devices. For example, one or more inflation pulses can inflate a cuff bladder to the target pressure of between 110 and 130 mm Mercury in less than 250 ms, and possibly even in less than 100 ms. In one configuration, a cuff bladder is inflated by opening an inflation valve in a first inflation stroke from about 5-10 mm Hg to a pressure below 110 mm Hg. The inflation stroke is terminated by closing the inflation valve. Cuff bladder pressure is then measured, for example using a pressure transducer, either with or without a settling delay. If a processor determines that the cuff bladder pressure is below the target pressure, the inflation valve is opened for a second or further inflation stroke and the process repeated. In a further configuration, if the processor detects that the cuff bladder pressure is greater than the target pressure, a deflation valve can be opened for a deflation stroke for a selected time to correct for the pressure overshoot. The selected time may be based on known deflation pressure/time curves, an estimate of the time necessary to deflate the cuff bladder to the target pressure, or based on ongoing pressure readings. The deflation valve is then closed, and the process repeated until the target pressure is reached. In any of the examples described herein, the target pressure can be a selected pressure or a range of pressures.

In a further example of methods and apparatus for improving vascular blood flow, a peripheral arterial disease pump assembly having one or more inflation cuff bladders can have pressure applied to the cuff bladder at a high frequency. The frequency can be between one and 100 Hz or more. The high-frequency pressure pulses can be applied continuously or at any of one or more stages of the operation of the pump assembly. For example, high-frequency pressure pulses can be applied during an inflation stage, a static stage and/or a deflation stage. Another way of applying a higher frequency superimposed upon an applied cuff bladder pressure is to attach to the exterior of the cuff a vibrating mechanism such as those that use a motor with eccentric weight. Other vibratory mechanisms such as an oscillating solenoid, buzzer mechanism or piezoelectric material may be used.

When stresses are applied to vessels under certain circumstances, biochemical substances such as growth-related proteins may be released from cells within the vessel that relate to vessel growth. Such substances are released due to stresses applied to the vessel's cells including endothelial cells which line the vessel's interior. Shear stress in particular can be created and applied to stimulate endothelial cell expression of biochemical substances, and by rapid application of external compression, additional biochemical response effects can be produced. The rapid application of compression pulses therefore has multiple effects on the individual with obstructed arterial flow to the limbs. Acutely, limb blood flow is significantly increased with certain modes of rapid compression while vessel growth is stimulated over a longer period of time using other modes of rapid compression. In one example of methods and apparatus for improving vascular blood flow, a peripheral arterial disease pump assembly having one or more inflation cuff bladders can be used to apply therapy or pressure sequences according to a first mode and apply therapy or pressure sequences according to a second mode different from the first mode to effect acute blood increases and stimulate longer term vascular growth as may be needed by the individual with arterial disease. In one configuration, the first mode can effect acute stimulation, and the second mode can effect more long term stimulation effects.

In another example of methods and apparatus for improving vascular blood flow, a peripheral arterial disease pump assembly having one or more inflation cuff bladders can be used to apply therapy or pressure sequences according to a first mode and apply therapy or pressure sequences according to a second level different from the first mode. In this example, during a therapy session or therapy period, which may for example be 60 minutes or any other suitable period selected by the user/operator, the therapy or pressure sequences according to the first mode are not repeated for 100% of the time, but one or more other modes are included in the therapy period. In one configuration, the first mode can be the conventional therapy or pressure sequences, and the second mode can be a high-frequency pressure pulse sequence. A different mode can be the same frequency as conventional therapy or sequences but different pressure profiles. In one example, one mode can be the conventional therapy or pressure sequence of inflation and hold for 3 seconds, followed by deflation and hold for 17 seconds, for an overall period of 20 seconds, and the wave form repeated. The pressures in the one mode have the baseline pressure of between 5 and 10 mm Hg and the target or high-pressure of between 110 and 130 mm Mercury. A second mode can be inflation and hold for approximately a half second and deflation and hold for approximately 2 seconds with repeat, at similar pressures as in the first mode. A third mode can be inflation and hold for one second, and deflation and hold for one second, at similar pressures as in the first mode. Another mode can be inflation and hold for approximately 300 milliseconds and deflation and hold for approximately 900 milliseconds with repeat, at similar pressures as in the first mode. Further modes can be the same as the first, second and third modes but at different low and/or high pressures, for example low pressure of 10-30 mm Hg and/or high pressure of 80-120 or greater than 150 mm Mercury. Modes may also include high frequency at low intensities as previously described, and/or low frequency at high intensities. Other combinations are also possible. Modes can be varied and combined as desired to achieve the desired combination.

In any of the treatment modes described herein, methods and apparatus for arterial compression therapy can be applied for a treatment regimen having a duration at least 50% greater than conventional treatment regimens. In one example, a peripheral arterial disease pump assembly can be operated to apply treatment for approximately 90 min. or more, and even as high as 120 min. or more, for any given mode or for a combination of modes described herein. A longer treatment regimen may cause a biochemical response in the vessels that does not occur in conventional treatment regimens. The duration of any given treatment modes may be tailored to the needs of the particular patient.

These and other examples are set forth more fully below in conjunction with drawings, a brief description of which follows.

BRIEF DESCRIPTION OF THE DRAWINGS

FIG. 3A shows a possible waveform for use with the therapy device of FIG. 2.

FIG. 3B shows a possible waveform for use with the therapy device of FIG. 2.

FIG. 4 shows a detail of the wave form in FIG. 3B.

DETAILED DESCRIPTION

Figure 1:
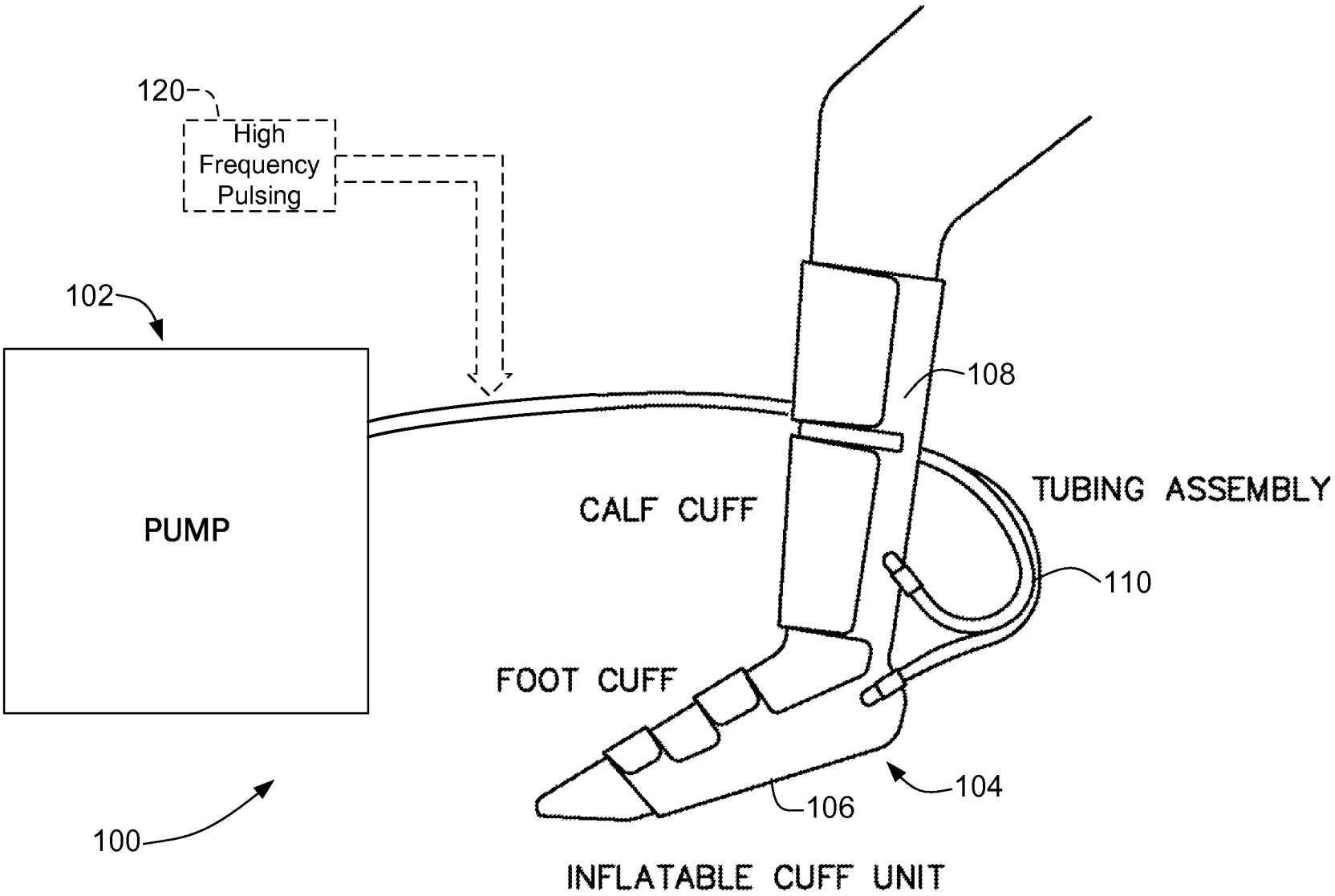
FIG. 1 is a schematic of a pneumatic patient therapy device.

This specification taken in conjunction with the drawings sets forth examples of apparatus and methods incorporating one or more aspects of the present inventions in such a manner that any person skilled in the art can make and use the inventions. The examples provide the best modes contemplated for carrying out the inventions, although it should be understood that various modifications can be accomplished within the parameters of the present inventions.

Examples of pumps and of methods of making and using the pumps are described. Depending on what feature or features are incorporated in a given structure or a given method, benefits can be achieved in the structure or the method. For example, pumps using higher frequency pulses, for example either as the compression therapy or as pulses superimposed on a compression therapy, can improve vascular function. Additionally, or alternatively, a pump with a higher inflation rate can improve vascular function, and may also provide more predictable results. One or more of these results may also be achieved through a more simplified pump configuration, which may also reduce cost and unit weight.

In some configurations of pumps, improvements can be achieved also in a more flexible system that can be used to provide a larger number of treatment modes, for example. A more flexible system may also provide more control over operation of the pump, and also may provide feedback, for example pressure sensing, as well as better control using such feedback.

These and other benefits will become more apparent with consideration of the description of the examples herein. However, it should be understood that not all of the benefits or features discussed with respect to a particular example must be incorporated into a pump, component or method in order to achieve one or more benefits contemplated by these examples. Additionally, it should be understood that features of the examples can be incorporated into a pump, component or method to achieve some measure of a given benefit even though the benefit may not be optimal compared to other possible configurations. For example, one or more benefits may not be optimized for a given configuration in order to achieve cost reductions, efficiencies or for other reasons known to the person settling on a particular product configuration or method.

It should be understood that terminology used for orientation, such as front, rear, side, left and right, upper and lower, and the like, are used herein merely for ease of understanding and reference, and are not used as exclusive terms for the structures being described and illustrated.

Examples of a number of pump configurations and of methods of making and using the pumps are described herein, and some have particular benefits in being used together. However, even though these apparatus and methods are considered together at this point, there is no requirement that they be combined, used together, or that one component or method be used with any other component or method, or combination. Additionally, it will be understood that a given component or method could be combined with other structures or methods not expressly discussed herein while still achieving desirable results.

Peripheral arterial compression pump assemblies are commonly used to apply pneumatic pressure to limbs, for example a person's legs. In one example of an assembly 100 (FIG. 1), the assembly includes a pump 102 and an inflatable cuff unit 104. The inflatable cuff unit typically includes a foot cuff 106 and a calf cuff 108, though it is understood that the assembly can omit one or the other of the cuffs. Other cuffs can be included in addition to or in place of one or both of the foot cuff and the calf cuff, for example a thigh cuff. Within each cuff there are one or more fluid bladders that when filled, apply pressure to the limb. For simplicity herein, we will assume only one bladder per cuff but multiple bladders may be configured within each cuff. A tubing assembly 110 connects the pump 102 with respective ones of the foot cuff 106 and the calf cuff 108. Typically, a single tube connects pneumatic flow from a foot valve to the foot cuff 106, and a single tube connects pneumatic flow from a calf valve to the calf cuff 108, and each tube is used for both inflation and deflation of the respective cuff. While other arrangements are possible, the conventional arrangement for the tubing assembly 110 shown in FIG. 1 is efficient.

In the present example of the pump assembly 100 shown in FIG. 1, the pump assembly is a typical or conventional peripheral arterial compression pump assembly presently in use. The general structure and operation of the pump assembly is described above in conjunction with the Related Art and is similar to that described with respect to U.S. Pat. No. 6,129,688. Added to the pump assembly 100 in the present example is a high frequency pulsing assembly 120. In the present example, the pulse assembly 120 can be a mechanical or pneumatic device applying high frequency pulses to the fluid (typically air) within one or more of the tubes in the tubing assembly 110. While it is possible that high frequency pulses can be applied to only one fluid flow line, high frequency pulses will more often be applied to the fluid corresponding to each cuff in an identical or similar manner to that applied to the other cuffs. The remaining discussion herein will be that for applying high frequency pulses to fluid corresponding to a given cuff, and it will be understood that the same discussion applies to application of high frequency pulses to the fluid corresponding to each other cuffs, if such pulses are applied to such cuff.

In one configuration, high frequency pulses are applied mechanically to the tube for a given cuff. The pulses can be applied to a tube by constricting the tube, such as by cyclically applying a bar, disc or other object to an external surface of the tube to reduce the cross-sectional area of flow within the tube. Constriction may also be carried out through application of another fluid, for example a fluid having the same or greater density than the fluid within the tube, across a defined area of the tube to constrict the tube. Other mechanical means may be used to constrict the cross-sectional area of flow within the tube.

In another configuration, high frequency pulses can be applied pneumatically to the fluid within the tube by way of a coupling in the tube providing for fluid flow into and out of the tube between the tube and the high-frequency pulsing device 120. In this example, the fluid in the high-frequency pulsing device 120 would be the same as the fluid in the tubing assembly 110. Pneumatic pulsing can be carried out with a fast-acting solenoid pump, or other pumps suitable for operating at the desired frequency. Other assemblies for applying a high-frequency pulse to the fluid in the tubing assembly 110 can be used. High frequency pulsing may also be applied directly to a cuff using a mechanical vibrator such as that created by a motor with eccentric weight. The vibrator mechanism may be integral to the cuff or optionally applied as a separate device with its own internal power source.

The frequency of the high-frequency pulses can be selected as desired. In one example, the frequency is greater than or equal to one every 20 seconds. Where the frequency is equal to one every 20 seconds, which is the same as typical therapy pump frequencies, the pulses can be applied at a different phase than that from the therapy pump. In another example, the frequency can be greater than or equal to one every minute, or as high as 30, 45 or even 100 Hz. The selected frequency can be determined based on the frequency that is believed to produce the optimum therapeutic effect, and is presently believed to be about 45 Hz. However, where the high-frequency pulses are applied in conjunction with the low-frequency pulses from the pump 102, what is determined to be an optimum therapeutic effect may be influenced by the baseline therapy provided by the compression pump assembly.

In any of the examples described herein for applying high-frequency pulses to a cuff, such pulses can be applied continuously, during cuff inflation, during cuff deflation, during the period when the cuff is maintained inflated, during the period when the cuff is maintained deflated or at its baseline pressure, or any combination thereof within a given cycle. High-frequency pulses can also be applied throughout an entire treatment regimen, for example during a complete 60, 90 or 120 min. treatment, or at different stages of the treatment, for example at the beginning, at the end, or in the middle. In a further alternative, high-frequency pulses can be applied intermittently throughout a 60, 90 or 120 min. treatment.

In other examples described more fully below, high-frequency pulsing can be applied by modifying the pump 102 to apply the pulses externally to tubing inside the pump, or to apply pulses pneumatically to the fluid used to inflate a cuff or to keep the cuff inflated.

In another example of a peripheral arterial compression pump, a pump 200 (FIG. 2), the pump includes a number of components also present in conventional pumps. These are a pressurization pump 202 coupled to a pressure tank 204. The pump takes in air or other fluid from an inlet 206 and pressurizing the air tank 204 to a predetermined pressure.

Also as with conventional pumps, the pump 200 includes a pressure relief valve 208, configured to keep the air tank 204 at 20 PSI. Also as with conventional pumps, the pump 200 includes a monitor circuit 210 and a control circuit 212, but the monitor and control circuits are configured not only with features similar to those in conventional pumps, but also with additional features as described herein.

Figure 2:
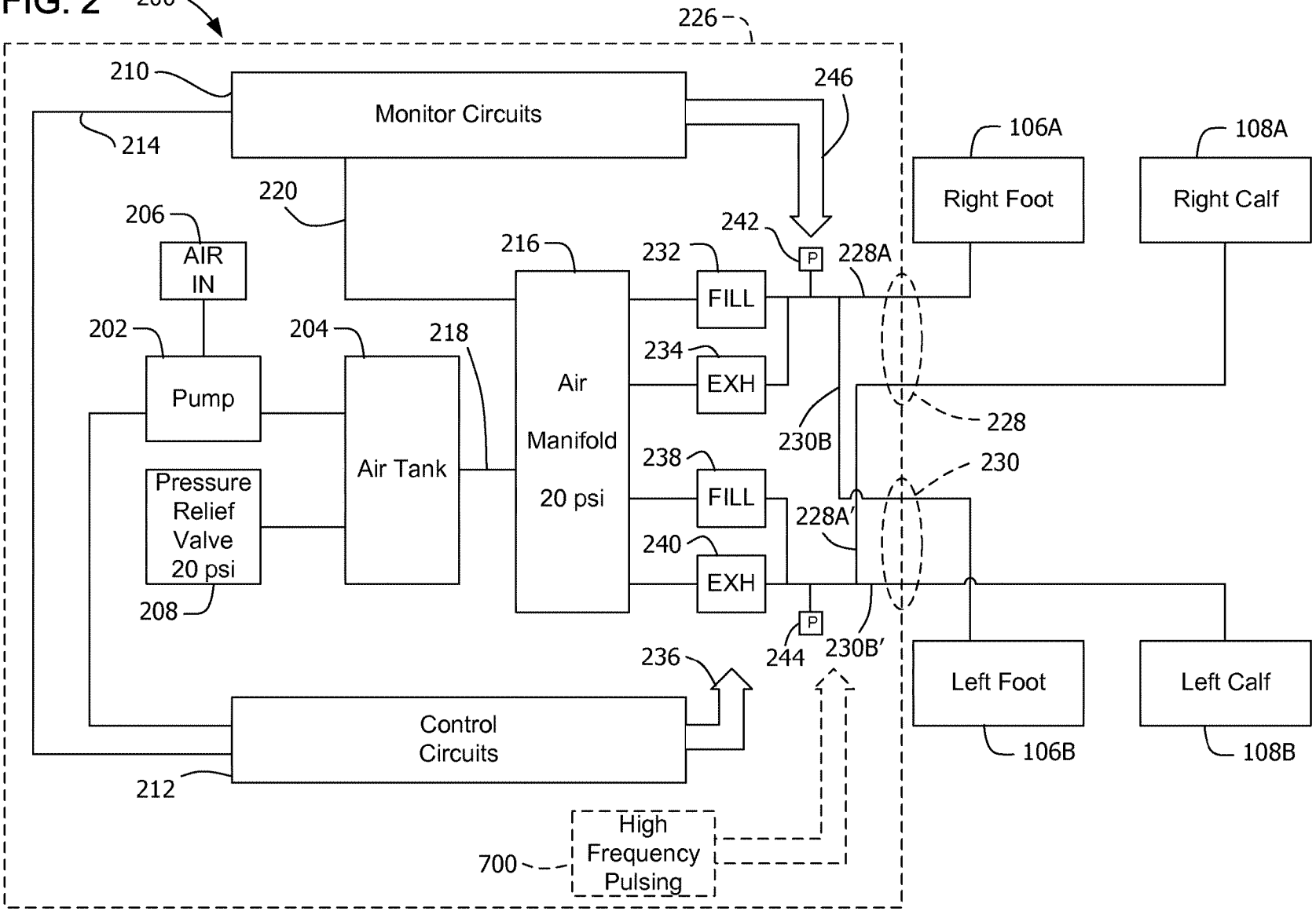
FIG. 2 is a schematic block diagram of a further therapy device.

As with a conventional compression pump, electronic control is divided between monitor-side circuits and control-site circuits. The circuits include power supply (not shown) receiving power from an external power supply such as a wall socket through a power cord (not shown) and regulation with a power fail detection. It also includes display and alarm indicators on the monitor side, pressure transducer amplifiers on the monitor side and the control side, a motor stall detector on the monitor side, a timing and sequencing circuit on the control side, an alarm indication panel on the monitor side as well as other monitoring circuits. In the present pump 200, the monitor side circuit 210 includes pressure transducer amplifiers for amplifying the signal from any pressure transducers that might be used in the pump. While it is understood that pressure transducers can be omitted from the pump, while still achieving other benefits of the present inventions, the present pump 200 in one configuration will include pressure transducers for sensing the pressure in at least one fluid line for at least one cuff. The present pump also includes a pressure and timing monitor for monitoring the pressure from pressure transducers, and for also monitoring the timing of various operations in the pump. As shown in FIG. 2, the monitor circuit 210 communicates with the control circuit 212 and vice versa over the line or bus 214, though it should be understood that the monitor and control circuits will commonly be located on a single printed circuit board. The monitor and control circuits in the present example include two 8-bit microcontrollers one for the control functions and one for the monitor functions. Each microcontroller is flash-programmable and may have its own firmware.

The control circuits 212 include a motor control for controlling the pressurization pump 202. The control circuits also include valve solenoid drivers for controlling inflation and deflation valves, described more fully below. Additionally, where high-frequency pulsing is integrated into the monitoring and control circuits, the control circuit can include appropriate drivers for carrying out the high-frequency pulsing. Alternatively, as discussed more fully below, high-frequency pulsing can be carried out using controls independent of the monitor circuits 210 and control circuits 212.

The pump 200 includes an air manifold 216 in fluid communication 218 with the air tank 204. In the present example, the air manifold is mounted to the air tank 204 and is so configured that the air manifold has substantially the same pressure within the manifold as the pressure in the air tank, namely 20 PSI. The monitor circuits 210 may include a coupling 224 monitoring the pressure in the air manifold, for example so that the control circuit 212 can know when the pressurization pump 202 should be started to raise the pressure in the tank 204, and when to turn off the pressurization pump 202.

In the exemplary configuration of the pump 200, the internal components of the pump are contained and enclosed within a housing, represented by the dashed line 226 similar to conventional enclosures. The pump includes one or more pneumatic couplings represented schematically at 228 and 230 in the housing 226. In the present illustration, coupling 228 receives a coupling for the tubing assembly and cuff unit for a right foot and right calf cuff unit, and coupling 230 receives a coupling for a tubing assembly and cuff unit for a left foot and left calf cuff unit. The tubing assembly and cuffs are identical to those used with conventional compression pumps. A compression therapy assembly will typically include a compression pump such as 102 or 200, corresponding tubing assemblies and corresponding inflatable cuff units. The couplings 228, 230, the tubing assemblies and the inflatable cuff units can be any components acceptable for use with compression pumps such as those described with respect to pump 102 and pump 200.

The pump 200 includes pneumatic valves pneumatically connected to the air manifold 216. In the present example, the pneumatic valves are mounted directly onto the air manifold, though they can be mounted elsewhere inside the housing 226. The pneumatic valves include an inflation valve and a deflation valve whose functions are independently controllable. In the present example, the foot/ankle cuff assembly is controlled by a pneumatic valve assembly discrete from a pneumatic valve assembly used to control calf cuff assembly. However, it should be understood that the foot/ankle and calf cuffs can be controlled from a valve assembly in a unitary housing or assembly. Likewise in the present example, each of the right and left cuffs can be controlled by a pneumatic valve assembly discrete from a pneumatic valve assembly used to control the other cuff, from a valve assembly in a unitary housing or assembly.

In the present example of the pump 200, the pump includes an inflation or fill valve 232 in fluid communication with the manifold 216. As previously noted, the inflation valve is mounted directly to the manifold 216. The pump also includes a deflation or exhaust valve 234 also in fluid communication with the manifold 216. In the present example, the deflation valve 234 is also mounted directly to the manifold 216. In the exemplary configuration of the pump 200, the inflation valve 232 is a 2-position pneumatic valve and the deflation valve 234 is also a 2-position pneumatic valve. The inflation valve 232 and the deflation valve 234 are controllable independently of each other, for example by the control circuits 212 over a bus 236, represented schematically in FIG. 2. It should be understood that the bus 236 is appropriately coupled to the inflation valve 232 and the deflation valve 234 to control those valves independently as described herein. Additionally, it should be understood that the functions of the inflation valve 232 and the functions of the deflation valve 234 can be carried out by other valve configurations different from two discrete 2-position valves.

The distal or output portions of the inflation valve 232 and deflation valve 234 in the present example are coupled to pneumatic lines 228A and 230B inside housing 226, the opposite ends of which are coupled to the respective couplers 228 and 230. These pneumatic lines are used to control the inflation of the right foot cuff 106A and the left foot cuff 106B, respectively, when the respective cuffs are connected to the pump through the respective couplings.

Further in the present example of the pump 200, the pump includes a further inflation or fill valve 238 in fluid communication with the manifold 216. In the present example, the inflation valve is mounted directly to the manifold 216. The pump also includes a deflation or exhaust valve 240 also in fluid communication with the manifold 216. In the present example, the deflation valve 240 is mounted directly to the manifold 216. In the exemplary configuration of the pump 200, the inflation valve 238 is a 2-position pneumatic valve and the deflation valve 240 is also a 2-position pneumatic valve. The inflation valve 238 and the deflation valve 240 are controllable independently of each other, for example by the control circuits 212 over the boss 236, represented schematically in FIG. 2. The bus 236 is coupled to the inflation valve 238 and the deflation valve 240 to control those valves as described herein, as would be understood by one skilled in the art upon reviewing the present description. Additionally, it should be understood that the functions of the inflation valve 238 and the functions of the deflation valve 240 can be carried out by other valve configurations different from two discrete 2-position valves. In one example of inflation valves and deflation valves, the valves can be Mac valves, for example those under model numbers 36A-B00-JDAA-1BA (in the present example valves 232, 234, and 238 used to FILL foot and calf bladders 106 and 108, respectively, and to EXHAUST the foot bladders 106), and 37A-C10-HDAA-1BA (in the present example valve 240 used for calf bladder EXHAUST). In one configuration, one or each of the deflation valves is larger than one or each of the inflation valves, to improve deflation of the respective cuff. For example, the pressure differential across an inflation valve is significantly higher than the pressure differential across a deflation valve, and the process of deflation can be improved by having a larger valve, for example a valve with a larger cross-sectional area in the calf cuff flow path. Other valve configurations can also be used.

The distal or output portions of the inflation valve 238 and the deflation valve 240 in the exemplary configuration are coupled to pneumatic lines 228A' and 230B' inside the housing 226, the opposite ends of which are coupled to the respective couplers 228 and 230. These pneumatic lines are used to control the inflation of the right calf cuff 108A and the left calf cuff 1088, respectively, when the respective cuffs are connected to the pump through the respective couplings.

With this configuration of pneumatic valves, there are two 2-position pneumatic valves for controlling one or more foot cuffs, and there are two 2-position valves for controlling one or more calf cuffs. The pressurization of the foot cuff (and similarly the pressurization of a calf cuff) can be controlled more discreetly, and the inflation function can be controlled separately from the deflation function of the same cuff. With this configuration, inflation of a cuff (either foot cuff or calf cuff) on the one hand and keeping the cuff inflated on the other hand can occur with different settings for the inflation valve. Additionally, because cuff inflation is carried out with one setting of the inflation valve and keeping the cuff inflated is carried out with another setting of the inflation valve, the cuff (either foot cuff or calf cuff) can be inflated with multiple inflation pulses, for example with the cuff inflation being held static between sequential or adjacent inflation pulses. Additionally, while the cuff inflation is held static, pneumatic pressure representing the present cuff inflation pressure can be sensed (for either the foot cuff or the calf cuff), as discussed more fully herein. Furthermore, a cuff (either the foot cuff or the calf cuff) can be deflated using the deflation valve while the inflation valve is in the position corresponding to static cuff inflation.

In the present example where the pneumatic valves 232-234 and 238-240 are mounted either directly or indirectly to the manifold 216, no pressure regulator is used to change or adjust the pressure in the manifold as seen by the pneumatic valves. Therefore, the pneumatic valves apply to their respective pneumatic lines going to the respective cuffs a pressure that is approximately the same as that in the manifold, namely 20 PSI. While normal pressure losses occur between the manifold and a tubing assembly such as 110, arising from fluid flow, and other known loss mechanisms, such pressure loss between the manifold 216 and any tubing assembly 110 is not significant. Consequently, the fluid pressure in the tubing assembly 110 is close to 20 PSI when a corresponding valve between the manifold and the tube is open, and it is not believed that the pressure at an outlet of an open pneumatic valve is any less than 90% of the pressure in the manifold 216. The higher pressure can be used to more quickly inflate a cuff. Additionally, omitting any components between the air manifold 216 and the tubing assembly 110 that would drop the pressure between the manifold and the tubing assembly more than 10% provides a more efficient and cost effective assembly.

While pressure sensing transducers can be omitted, the present compression pump 200 includes a first pressure transducer 242 in line or otherwise configured to sense a pressure corresponding to the foot cuff. In the illustrated configuration, the pressure transducer 242 is positioned relative to the pneumatic flow lines between the inflation and deflation valve 232 and 234, respectively, and the couplers 228 and 230, respectively. Additionally, the present compression pump 200 includes a second pressure transducer 244 in line or otherwise configured to sense a pressure corresponding to the calf cuff. In the illustrated configuration, the pressure transducer 244 is positioned relative to the pneumatic flow lines between the inflation and deflation valve 238 and 240, respectively, and the couplers 228 and 230, respectively. Each pressure transducer is configured to sense the pneumatic pressure in their respective pneumatic flow lines. The pneumatic pressure transducers are preferably fast-settling pressure transducers for accurately sensing their respective pneumatic pressures when the corresponding inflation valve is in the static pressure configuration and the deflation valve is in the static pressure configuration, and the pneumatic pressure approaches or has achieved equilibrium.

The pneumatic pressure sensing transducers 242 and 244 are properly coupled through a monitoring bus 246 to the monitor circuits 210. The pressure sensing transducers are coupled to the monitor circuits 210 in such a way that the pressures in the respective pneumatic lines can be accurately sensed. The sensed pressures can then be used to feedback information to the appropriate processor or processors, for example to determine or calculate remaining pressurization intervals or pulses for further inflation or valve action for deflation, and to have the control circuits 212 inflate or deflate a cuff.

Other configurations of compression pumps can also be used for operating in one or another of the ways described herein. For example, other devices or means for sensing pressure in the pneumatic lines can be used than pressure transducers, or pressure sensors can be omitted if desired, for example if pressure sensing is not used with a conventional compression pump when high-frequency pulsing has been added. Other pneumatic valves can be used instead of the 2-position valves for producing the desired inflation and/or pulsing.

The compression pumps described herein can be used for a number of applications. In addition to pneumatically inflating inflatable cuff units in the same way as current compression assembly, the pumps described herein can be used in a number of other ways as well. In one example, compression pumps such as those described herein can be configured to provide a plurality of pneumatic pulses to one or more of the cuffs in an inflatable cuff unit. In the present examples, operation will be described with respect to a single cuff, but it will be understood that such operations can be applied to only a single cuff, fewer than all cuffs in an assembly, or to all cuffs in an assembly, according to the desired application profile. Operations as to multiple cuffs can be identical to each other, or they can be varied from one to the other, as desired, or they can be grouped as desired.

In the present example, multiple pneumatic pulses are applied to increase pressure in a cuff. Alternatively, multiple pneumatic pulses can be applied to decrease pressure in the cuff, and/or multiple pneumatic pulses can be applied while pressure in a cuff is substantially static. In the situation where multiple pneumatic pulses are applied to increase pressure in a cuff, an inflation valve, for example inflation valve 232, can be open for an interval or for a period, to apply air at the pressure of the manifold to the cuff. At the end of the interval or the open period, the valve is closed, after which additional inflation pulses can be applied until the desired cuff pressure is reached, or other actions taken.

An example of multiple inflation pulses is illustrated in FIGS. 3A, 3B and 4, corresponding to inflation of a foot/ankle cuff and a calf cuff. These Figures illustrate one cycle of an otherwise conventional compression of a foot/ankle cuff and calf cuff but where the inflation of the respective cuffs is accomplished with multiple pulses. As shown in FIG. 3A, the foot/ankle cuff, for example 106A, is inflated to a baseline pressure P1 of approximately 5-10 mm Hg, at which it stays until further inflation begins. Inflation is then begun for a first inflation pulse or inflation stroke 310 by opening the pneumatic valve, for example valve 232 for a selected time or interval based on signals from the control circuits 212. The interval is selected in the present example so that the target pressure for the cuff is not reached during the first inflation pulse. At the end 312 of the first inflation pulse, the fluid in the pneumatic line stabilizes, which is indicated by the inflection or transition at the end 312 of the first inflation pulse. After the end of the first inflation pulse, the pressure in the pneumatic line is sensed, for example by pressure transducer 242, and the data is received by the monitor circuits 210. A processor then calculates the remaining pressure necessary to reach the target pressure and calculates the time required for the inflation valve to be open to reach the target pressure. The inflation valve 232 is then opened again by the control circuits 212 for the determined interval for a second inflation pulse or inflation stroke 314. The process is repeated until such time as the monitor circuits 210 compare the sensed pressure at the end 316 of a pulse to the target pressure, for example a pressure of between 110 and 130 mm Hg, and determines that the sensed pressure is at or above the target pressure. If the sensed pressure is at the target pressure, the inflation valve 232 is kept closed and the deflation valve 234 is kept closed and the pressure in the pneumatic line and therefore the cuff is substantially maintained. Conversely, if the sensed pressure is greater than the target pressure, the inflation valve 232 is kept closed and the deflation valve 234 is opened to reduce the pressure in the pneumatic line to the target pressure. The deflation valve 234 can be opened during a deflation interval (DT1=t5−t4 in FIG. 4) calculated by the monitor circuits 210 as a function of the pressure at the end 316 of the pulse (overshoot pressure) and the target pressure, or the deflation valve 234 can be opened for multiple pulses and the pressure sensed at the end of each pulse until the monitor circuits 210 determine that the target pressure has been reached.

In an alternative method of multiple inflation pulses, the interval can be a fixed interval, applied multiple times until such time as the pressure sensed in the pneumatic line is equal to or greater than the target pressure. If the pressure is greater than the target pressure, the deflation valve, for example deflation valve 234, can be opened for intervals until such time as the target pressure is reached.

Once the target pressure is reached, the valves are kept static, for example keeping the inflation valve 332 closed and keeping the deflation valve 234 closed for an interval determined by the compression program stored or entered into memory. In the illustrated examples, the inflation interval IT1 is 3 seconds as in conventional compression cycles. There is a slight decay or pressure decrease from the target pressure due to relaxation of cuff fabric, and the like.

Figure 6:
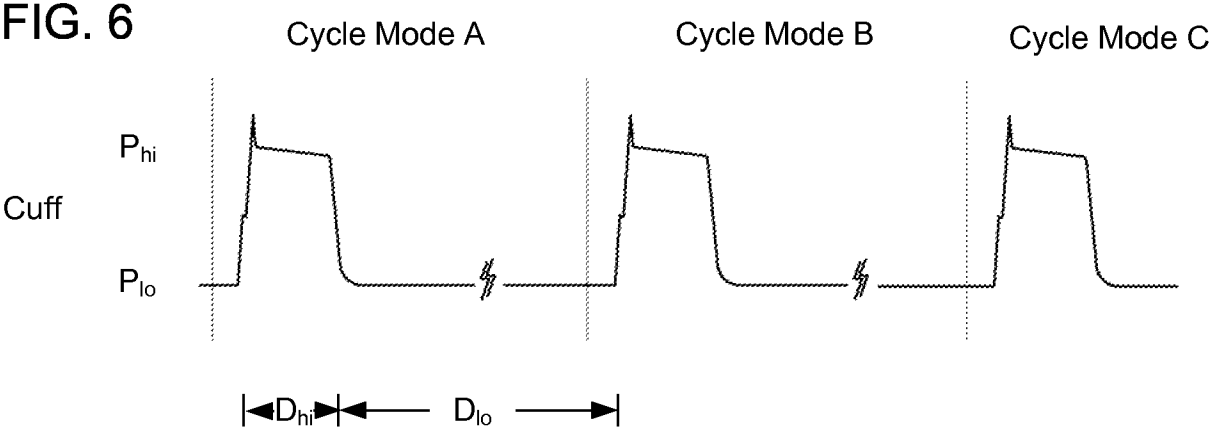
FIG. 6 shows cycles of waveforms that can vary between each other.

At the end of the 3 second inflation interval, as determined by an appropriate timer in the monitor and control circuits, the control circuits 212 open the deflation valve 234 to deflate the cuff over an interval or a period DT1 determined to bring the cuff back to the baseline pressure of 5-10 mm Hg at which time the deflation valve 234 is closed. The cuff then remains at the baseline pressure for the conventional 17 seconds (represented generally as Dlo in FIG. 6) and the cycle repeats.

In addition to inflation and deflation of the foot/ankle cuff, the calf cuff can be inflated, but need not be. Where the calf cuff is inflated according to a cycle similar to conventional cycles, the calf cuff is inflated (FIG. 3B) in a manner identical to that for the foot/ankle cuff discussed with respect to FIG. 3A, but after a one second delay DL1. Specifically, and considering FIG. 3B and the detail thereof shown in FIG. 4, the calf cuff is inflated at the baseline pressure P1 about 5-10 mm Hg. At time t1, as determined by a timer in the monitor and control circuit, the inflation valve 238 is opened for a first interval as determined by the control circuits 212. At the end of the interval, namely t2, the inflation valve 238 is closed, and after a settling time, the monitor circuits 210 read the pressure p2 from transducer 244 in the pneumatic line for the calf cuff. As can be seen visually in FIG. 4, the static interval between t2 and t3 is significantly less than the inflation pulse interval, between t1 and t2. The monitor circuits 210 calculate the pressure difference (pt−p2) necessary to reach the target pressure and calculate or determine the interval to be used in keeping the inflation valve 238 open to reach the target pressure. The control circuits 212 then open the inflation valve 238 at t3 for the defined interval until t4, after which the control circuits 212 close the inflation valve. The monitor circuits 210 then sense the pressure again at the transducer 244 and compare it to the target pressure. If the pressure is below the target pressure, the process repeats for one or more additional pressure pulses. If the pressure is at the target pressure, the cuff pressure is maintained by the control circuit by keeping the inflation valve 238 and the deflation valve 240 closed. If the pressure is higher than the target pressure, for example p3, the monitor circuits 210 calculate the pressure differential and the interval required for opening the deflation valve 240 to bring the pressure down to the target pressure pt. The control circuits 212 then open the deflation valve 244 the determined interval, to t5, after which the deflation valve 244 is closed. The total inflation time IT2 in one example is less than 500 ms. If there is pressure overshoot, where the pressure is higher than the target pressure, the duration of the overshoot DO is preferably no greater than 200 ms. The calf cuff is then kept inflated by the control circuits 212 by keeping the inflation valve 238 closed and the deflation valve 240 closed for the full 3 second interval IT3 of compression, after which the control circuits 212 open the deflation valve 244 an interval necessary to bring the cuff pressure down to the baseline pressure again, p1, for the remaining 17 second interval of the cycle. The foot/ankle cuff inflation cycle and the calf cuff inflation cycle then continue for the remainder of the therapy session, as depicted schematically in FIG. 5, which are continuations of FIGS. 3A and 3B.

Figure 4A:
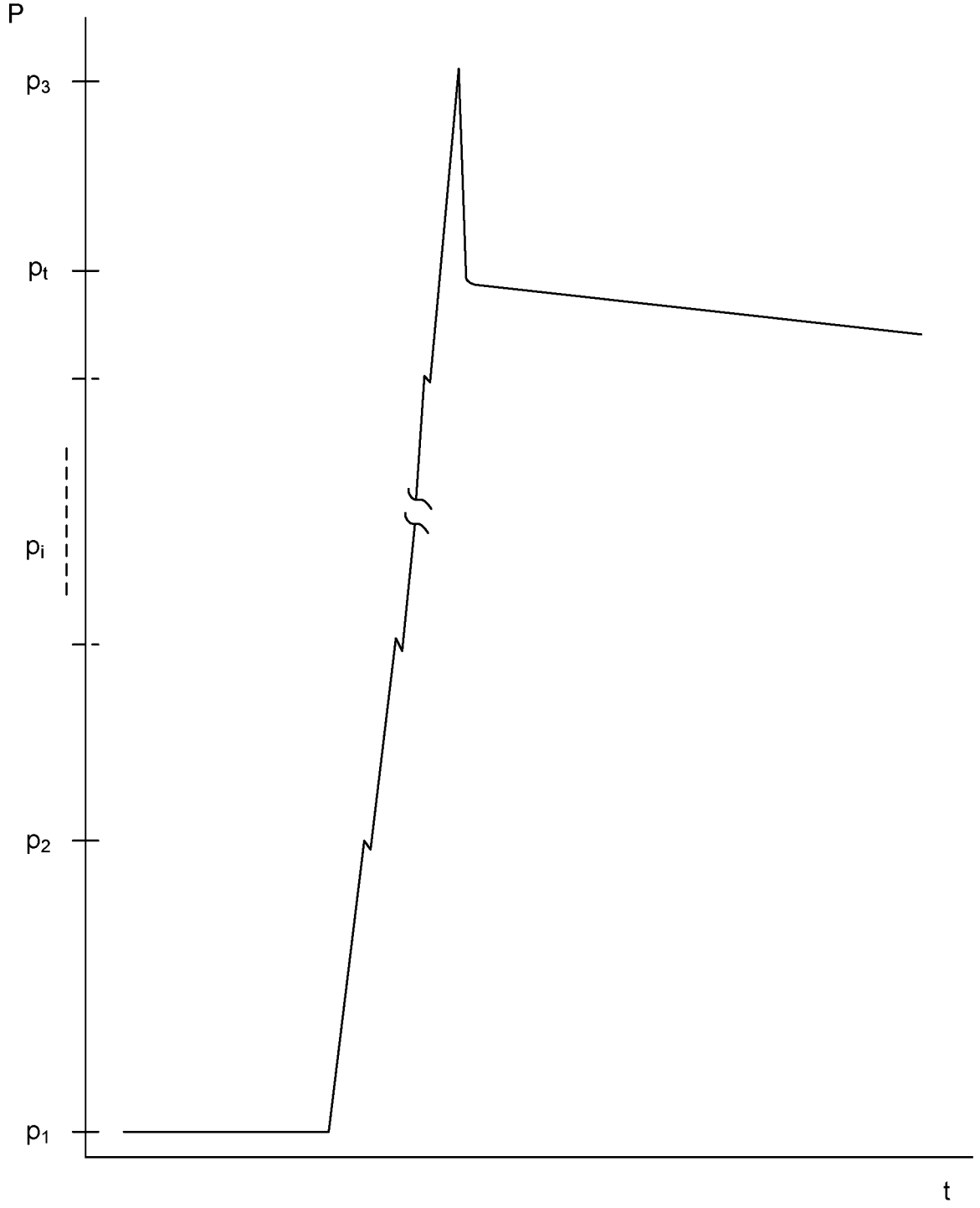
FIG. 4A shows a detail of a further example of a waveform.
Figure 5:
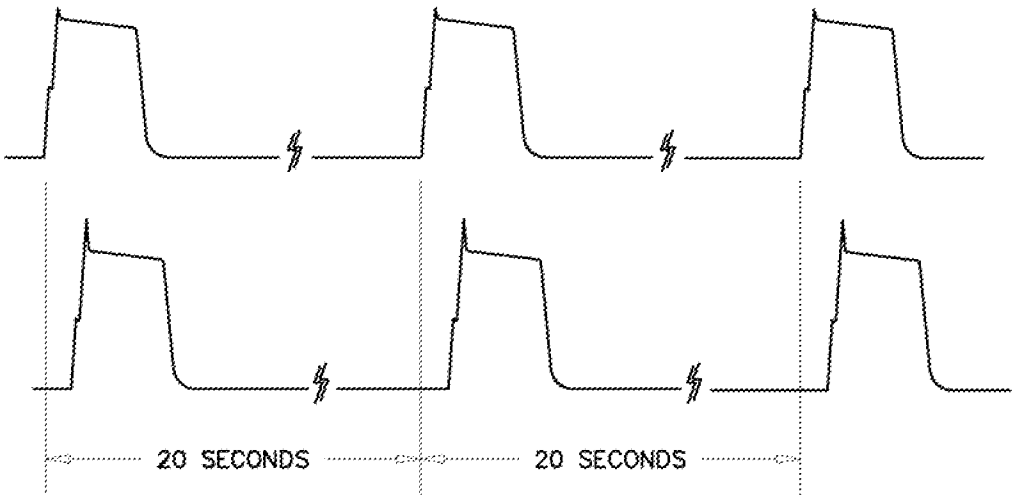
FIG. 5 shows waveforms for application of therapy for a foot/ankle cuff and a calf cuff.

Multiple pulses can be applied over fixed intervals, over varied intervals as calculated by the monitor and control circuits, or otherwise. Multiple pulses can be applied on inflation, as described in the examples of FIGS. 3A, 3B and 4, during periods of static pressure such as when the cuff is inflated or at the base pressure, on deflation, or continuously such as with high-frequency pulsing superimposed on the pressure curves of a cuff. In the example illustrated, there are two inflation pulses separated by a single static pressure period, but there can be a larger number of inflation pulses, each of which may be separated by respective static periods. For example, the plurality of pulses increasing pressure illustrated in FIGS. 3A, 3B, and 4 illustrate first and second pressure pulses applied, and FIG. 4A illustrates an example of a first pressure pulse similar to that illustrated in FIG. 4, from t1 to t2, at which point the pressure is at p2, and further pressure pulses applied to raise the pressure from p2 to p3, with respective static periods. However, when the pneumatic lines see a pressure of approximately 20 PSI, total inflation time can be less than 400 ms, and even less than 250 ms. Where pressure pulses are approximately 30 ms, total inflation time may be the sum of 1, 2 or 3 30 ms pulses, significantly less than 250 ms. Applying pressure at significantly greater than 120 mm Mercury to inflate cuffs can significantly decrease inflation times.

Having functionally discrete pneumatic valves allows greater flexibility in operating an arterial compression pump. In one therapy system, as depicted in FIGS. 3A-5, the foot/ankle cuff and the calf cuff are operated for compression identically except that the cycle for the calf cuff is shifted by one second. In conventional compression pumps, the high pressures are approximately 120 mm Hg for about 3 seconds followed by about 17 seconds of low-pressure, for a cycle period of about 20 seconds. The high pressure was determined by a pressure regulator, and the high pressure was maintained by keeping a pneumatic inflation valve open at the high-pressure. Foot/ankle cuffs were on one valve and calf cuffs were on the second valve.

With the present configuration, the pump can apply to a cuff a first therapy mode for one 60 min. period of therapy and a second therapy mode for another 60 min. period of therapy. In other words, a pump can apply different therapy modes. Additionally, a given therapy mode can apply different cycle modes over the duration of the therapy mode. For example, a first cycle mode can have a pressure cycle identical to conventional therapies or a first cycle mode can have a pressure cycle identical to that shown in FIGS. 3A and 3B. For example, with reference to FIG. 6, Cycle Mode A for a cuff can have a low static pressure Plo of 5-10 mm Hg and pressure Phi of about 120 mm Hg. The duration of the high-pressure Dhi is approximately 3 seconds and the duration of the low-pressure Dlo is approximately 17 seconds. The next cycle may apply a Cycle Mode B at the same pressures but where Dhi is approximately 2 seconds and Dlo is approximately 2 seconds. The next cycle may be a Cycle Mode A again (not shown), or Cycle Mode B again (not shown), or a third mode Cycle Mode C at the same pressures as Cycle Mode A and B but where Dhi is approximately one second and Dlo is approximately 2 seconds. Alternatively, Cycle Mode C can be any of the foregoing, but one or more of the pressures are different. For example, low pressures may be 10-30 mm Hg, and high pressures can be between 80 and 120 mm Hg or greater than or equal to 150 mm Hg. These possible example modes are set forth in the following Table 1. Other combinations can be used to vary the therapy mode and to vary cycle modes. The durations are indicated as approximately and the durations in the Table 1 are considered approximate, plus or minus 10% the indicated duration, and it is considered that a duration can be higher or lower by approximately 10% and still achieve the desired results for the particular mode. As used herein, the term "approximately", for example but without limitation when used with respect to a time or a pressure, means plus or minus 10% of the stated quantity or magnitude.

TABLE 1

| Cycle Mode | $P_{hi}$ (mm Hg) | $P_{lo}$ (mm Hg) | $D_{hi}$ (sec) | $D_{lo}$ (sec) |
|---|---|---|---|---|
| A | 120 | 5-10 | 3 | 17 |
| B | 120 | 5-10 | 0.5 | 2 |
| C | 120 | 5-10 | 1 | 1 |
| D | 120 | 5-10 | 0.33 | 0.5 |
| E | 120 | 5-10 | 0.3 | 0.9 |
| F | 120 | 5-10 | 0.33 | 1.0 |
| G | 120 | 5-10 | 0.15 | 0.45 |
| H | 120 | 5-10 | 1.50 | 3.10 |
| I | 80-120 | 10-30 | 3 | 17 |
| J | . . . | . . . | . . . | . . . |

In a further example of the compression pump (FIG. 2) the pump can take any of the configurations described herein, and a high-frequency pulsing configuration 700 can be added to the pump. In these configurations, the high-frequency pulsing configuration 700 is applied to the fluid before the fluid reaches the connectors or couplers 228 and 230. In one configuration, the high-frequency pulsing system may be a mechanical or similar configuration to that of the high-frequency pulsing configuration 120 described with respect to FIG. 1, where the pulsing is applied to the pneumatic fluid lines within the housing 226. As a further alternative, high-frequency pulsing can be incorporated into the existing hardware and software, for example under control of the monitoring and control circuits 210 and 212 through one or more of the pneumatic valves 232, 234, 238 and/or 240. For example, pulses can be applied to pneumatic fluid in lines connecting one or more cuffs by relatively rapidly moving the pneumatic valve. For example, the pneumatic valve can be feathered on and off, or the existing valve configuration (whether on, off or somewhere in between) can be changed slightly and repeatedly to produce high-frequency pressure pulses in the cuff.

High-frequency pulsing can be carried out over a complete therapy session, either continuously or intermittently, and can be carried out over a complete cycle or over portions of a cycle. For example, high-frequency pulsing can be used on one or more of an inflation segment, a static segment or a deflation segment. In the examples illustrated in FIGS. 3A-4, the high-frequency pulsing of the first inflation pulse and the second inflation pulse leading up to the target pressure is high frequency relative to the conventional therapy frequency of one cycle per 20 seconds. High-frequency pulsing such as that which may be superimposed on an existing pressure profile can be as high as 100 Hz, but it is presently believed that 45 Hz is a desirable frequency for beneficial results. In addition to the pulsing illustrated in FIGS. 3A-4, higher frequency pulses can be applied during the inflation, and/or at other portions of the cycle.

Alternative to using one or more of the pneumatic valves 232, 234, 238 or 240, pneumatic pulsing can be applied to one or more of the fluid flow lines with an independent pneumatic pulsing system. For example, one or more pneumatic lines may be fluidly connected to an independent pulsing source, for example a high-frequency, low-volume/intensity solenoid pump or valve for pulsing the fluid in the pneumatic line. Other configurations for applying a high-frequency pulse to one or more of the fluid lines for the cuffs may also be used.

Having thus described several exemplary implementations, it will be apparent that various alterations and modifications can be made without departing from the concepts discussed herein. Such alterations and modifications, though not expressly described above, are nonetheless intended and implied to be within the spirit and scope of the inventions. Accordingly, the foregoing description is intended to be illustrative only.

What is claimed is:

1. A peripheral artery disease driving device for controlling pressure in a pressure cuff coupled to the driving device, the driving device including:

an inflation valve, a deflation valve, the deflation valve configured to function separately from inflation valve function, a monitor circuit, and a control circuit, wherein the control circuit in communication with the monitor circuit configured to control the driving device to apply compression to a limb from a baseline pressure to a second pressure higher than the baseline pressure, by controlling the driving device to:

apply pressure to the pressure cuff on the limb at a third pressure higher than the second pressure, during a period of increasing pressure from the baseline pressure to the second pressure for compression with the pressure cuff:

iteratively pause applying pressure at the third pressure, sense a pressure of the pressure cuff on the limb while pausing, and adjust application of pressure to the pressure cuff based on the pressure sensed, and interrupt applying pressure at the third pressure to the pressure cuff when the pressure of the pressure cuff reaches approximately the second pressure.

2. The driving device of claim 1 wherein the inflation valve and the deflation valve are controlled to keep the pressure cuff pressurized at the baseline pressure.

3. The driving device of claim 2 wherein the baseline pressure is between approximately 6 mmHg and 10 mmHg.

4. The driving device of claim 1 wherein the driving device is configured so that opening the inflation valve increases pressure in the pressure cuff, and that opening the deflation valve decreases pressure in the pressure cuff when the inflation valve is closed.

5. A peripheral artery disease pump comprising:

a pressurization tank, at least one pneumatic line connecting the pump to at least one pressure cuff, at least one control valve between the pressurization tank and the at least one pneumatic line, and a pneumatic flow path between an output on the pressurization tank and the at least one control valve, wherein there is no pressure regulator in the pneumatic flow path, a monitor circuit, and a control circuit, wherein the control circuit in communication with the monitor circuit configured to control the pump to apply compression to at least one limb from a baseline pressure to a second pressure higher than the baseline pressure, by controlling the pump to:

apply pressure to the at least one pressure cuff on the at least one limb at a third pressure higher than the second pressure, during a period of increasing pressure from the baseline pressure to the second pressure for compression with the at least one pressure cuff:

iteratively pause applying pressure at the third pressure, sense a pressure of the at least one pressure cuff on the at least one limb while pausing, and adjust application of pressure to the at least one pressure cuff based on the pressure sensed, and interrupt applying pressure at the third pressure to the at least one pressure cuff when the pressure of the at least one pressure cuff reaches approximately the second pressure.

6. The pump of claim 5 wherein the second pressure is at least 120 mmHg, and wherein the pump is controlled such that the second pressure of at least 120 mmHg is reached in less than approximately 1000 ms.

7. The pump of claim 6 wherein the at least one control valve is configured to have a closed configuration and a fully open configuration, and wherein the pressure at an outlet of the at least one control valve when the at least one control valve is in the fully open configuration is at least 90% of a pressure in the pressurization tank when the pressurization tank is pressurized.

8. The pump of claim 7 wherein the at least one control valve is part of at least one valve assembly, wherein the at least one valve assembly has three different valve configurations including an inflation configuration, a static configuration and a deflation configuration.

9. The pump of claim 8 wherein the at least one control valve comprises two valves including an inflation valve and a separate deflation valve.

10. The pump of claim 9 wherein the static configuration includes both of the inflation valve and the deflation valve closed.

11. The pump of claim 8 wherein the pressurization tank is pneumatically coupled to the at least one valve assembly without any pressure regulator between the pressurization tank and the at least one valve assembly.

12. The pump of claim 8 wherein a pressure drop between the pressurization tank and the at least one valve assembly is no more than approximately 10% when the pressurization tank is pressurized.

13. The pump of claim 8 wherein the at least one valve assembly is controlled to maintain the pressure of the at least one pressure cuff at the baseline pressure.

14. The pump of claim 5 wherein the pump is controlled to apply a therapy routine to the at least one pressure cuff, and wherein the therapy routine is applied according to a first cycle mode followed by applying the therapy routine according to a second cycle mode.

15. The pump of claim 14 wherein the therapy routine extends for a first period, and the first cycle mode is applied during a part of the first period and the second cycle mode is applied during another part of the first period.

16. The pump of claim 15 wherein the first period is approximately 60 minutes.

17. The pump of claim 15 wherein the at least one pressure cuff comprises a plurality of pressure cuffs.

18. The pump of claim 5 wherein the pump is controlled to apply pressure pulses to the at least one pressure cuff according to at least one cycle of inflation and deflation, and wherein the inflation includes a plurality of pulses.

19. The pump of claim 18 wherein the plurality of inflation pulses are spaced apart by a selected time period.

20. The pump of claim 5 further including a manifold between the pressurization tank output and the at least one control valve.

21. The pump of claim 5 wherein the pump is configured so that there is no more than approximately 10% pressure drop between the pressurization tank and the at least one control valve.

22. The pump of claim 5 wherein the pump is configured so that a pressure at the at least one pneumatic line is no less than approximately 90% of a pressure in the pressurization tank when the pressurization tank is pressurized and the at least one control valve is fully open.

23. The pump of claim 5 wherein the pump is controlled to apply pulses in the pneumatic flow path to the at least one pneumatic line.

24. The pump of claim 5 wherein the at least one control valve is a pressurization valve and wherein the pump further includes a depressurization valve.

25. The pump of claim 5 further including a pressure sensor downstream from the at least one control valve coupled to the control circuit, wherein the control circuit is configured to calculate when the pressure of the at least one pressure cuff will reach the second pressure.

26. A method of applying compression to a limb from a baseline pressure to a second pressure higher than the baseline pressure including:

applying pressure to a pressure cuff on the limb at a third pressure higher than the second pressure, during a period of increasing pressure from the baseline pressure to the second pressure for compression with the pressure cuff:

iteratively pausing applying pressure at the third pressure, sensing a pressure of the pressure cuff on the limb while pausing, and adjusting application of pressure to the pressure cuff based on the pressure sensed, and interrupting applying pressure at the third pressure to the pressure cuff when the pressure of the pressure cuff reaches approximately the second pressure.

27. The method of claim 26 further including decreasing pressure in the pressure cuff on the limb from the second pressure to approximately the baseline pressure.

28. The method of claim 27 wherein applying pressure to the pressure cuff on the limb includes opening a first valve, and decreasing pressure applied to the pressure cuff on the limb includes opening a second valve when the first valve is closed.

29. The method of claim 26 further including using a compression controller, a pressurization tank and a valve between the pressurization tank and the pressure cuff on the limb, and wherein applying pressure to the pressure cuff on the limb is such that a pressure drop between the pressurization tank and the valve is no greater than approximately 10% of the pressure in the pressurization tank when the pressurization tank is pressurized.

30. The method of claim 29 further including pressurizing the pressurization tank to approximately 20 psi.

31. The method of claim 26 wherein interrupting applying pressure at the third pressure applied to the pressure cuff occurs after approximately 500 ms or less.

32. The method of claim 31 further including opening a deflation valve after interrupting applying pressure at the third pressure.

33. The method of claim 26 wherein interrupting applying pressure at the third pressure includes closing a valve.

34. The method of claim 26 wherein applying pressure at the third pressure includes applying pressure at a pressure of at least approximately 20 psi.

35. The method of claim 26 wherein applying pressure at the third pressure includes applying pressure at the third pressure multiple times to reach the second pressure.

36. The method of claim 26 wherein applying pressure at the third pressure includes applying high-frequency pressure pulses to the pressure cuff on the limb.

37. The method of claim 26 wherein the third pressure is at least 10% greater than 120 mmHg.

38. A method of applying compression to a limb from a baseline pressure to a second pressure higher than the baseline pressure including:

applying pressure to a pressure cuff on the limb at a third pressure higher than the second pressure, during a period of increasing pressure from the baseline pressure to the second pressure for compression with the pressure cuff:

calculating a duration of pressurization at the third pressure necessary to reach the second pressure, and interrupting applying pressure at the third pressure to the pressure cuff when the pressure of the pressure cuff reaches approximately the second pressure, wherein interrupting applying pressure at the third pressure to the pressure cuff follows calculating the duration of pressurization at the third pressure necessary to reach the second pressure and includes interrupting applying pressure at the third pressure at the end of the calculated duration.

39. The method of claim 38 wherein applying pressure at the third pressure is done a plurality of times to reach the second pressure.

40. A method of applying compression to a limb from a baseline pressure to a second pressure higher than the baseline pressure including:

applying, a plurality of times to reach the second pressure, pressure to a pressure cuff on the limb at a third pressure higher than the second pressure, and during a period of increasing pressure from the baseline pressure to the second pressure for compression with the pressure cuff:

interrupting applying pressure at the third pressure applied to the pressure cuff when the pressure of the pressure cuff reaches approximately the second pressure, wherein interrupting applying the third pressure applied to the pressure cuff follows calculating a duration of pressurization at the third pressure necessary to reach the second pressure and includes interrupting applying pressure at the third pressure at the end of the calculated duration, and wherein the applying pressure at the third pressure a plurality of times is separated by at least one static pressure interval.

* * * * *